US008006532B2

(12) United States Patent
Trabattoni

(10) Patent No.: US 8,006,532 B2
(45) Date of Patent: Aug. 30, 2011

(54) WORKPIECE SUPPORTING DEVICE FOR A MULTIPLE-DIE HORIZONTAL FORGING PRESS

(75) Inventor: Roberto Trabattoni, Desio (IT)

(73) Assignee: Sacma Limbiate S.p.A., Limbiate (IT)

( * ) Notice: Subject to any disclaimer, the term of this patent is extended or adjusted under 35 U.S.C. 154(b) by 882 days.

(21) Appl. No.: 11/999,391

(22) Filed: Dec. 5, 2007

(65) Prior Publication Data

US 2008/0209977 A1 Sep. 4, 2008

(30) Foreign Application Priority Data

Dec. 6, 2006 (IT) ..... M12006A2349

(51) Int. Cl.
*B21D 45/02* (2006.01)

(52) U.S. Cl. ..... 72/344; 72/427; 470/152

(58) Field of Classification Search ..... 72/344, 72/345, 361, 427, 426, 461; 470/152
See application file for complete search history.

(56) References Cited

U.S. PATENT DOCUMENTS 3,122,179 A * 2/1964 Zimmerman et al. ..... 140/147
4,966,028 A * 10/1990 Sakamura et al. ..... 72/361

* cited by examiner

*Primary Examiner* — Debra M Sullivan
(74) *Attorney, Agent, or Firm* — Kirschstein, et al

(57) ABSTRACT

A workpiece supporting device for a multiple-die horizontal forging press comprises a transfer pliers arranged at each recess of a die and having a movable stem operating as a workpiece ejecting means, the stem being coupled, at one end portion thereof, facing a driving mechanism, through a coupling bracket, to a driving rod, one end of which, arranged at a recess of the die respectively of the transfer pliers, houses a workpiece restraining device, formed by a rocker mechanism, which can swing about a cross pivot pin and against a spring means affecting an arm of the rocker mechanism.

5 Claims, 4 Drawing Sheets

WORKPIECE SUPPORTING DEVICE FOR A MULTIPLE-DIE HORIZONTAL FORGING PRESS

BACKGROUND OF THE INVENTION

The present invention relates to a workpiece supporting device for a multiple-die horizontal forging press.

Prior cold forging pressing machines conventionally comprise a plurality of forging dies in each of which a rod iron, supplied from a rod iron coil, is gradually deformed, to provide, through a cold-deforming process, a piece having a desired end shape which may also be very complex.

Machines of the above mentioned type are also made by the Applicant, SACMA Limbiate S.p.A., from a long time.

Considering that the above mentioned cold-forging machines usually comprise up to six dies, in which the workpiece is gradually subjected to different deforming steps, and that the processing rate of modern cold forging machines is of 150 to 200 pieces per minute, malfunction problems have occurred with respect to a firm and safe gripping of the workpiece by the workpiece transfer or unloading pliers, at the end of the deforming operations.

The above mentioned drawbacks, related to a safe gripping of the workpieces as they are ejected by the individual forging dies, have been further aggravated for workpieces having large diameter variations and several steps, thereby making a perfect gripping of the piece by the transfer pliers a difficult operation.

Actually, it has been found that a complex configured workpiece cannot always be safely gripped by the gripping pliers, for example because of a continuously increasing production rate of the cold forging machines, thereby preventing the workpiece from being properly transferred from a deforming station to another deforming station.

Thus, notwithstanding several attempts to solve the above mentioned technical problem, a half-machined workpiece could still disengage from the transfer pliers jaws, thereby uncontrollably dropping inside the processing machine upstream of the deforming head.

Thus to overcome the above mentioned drawbacks, it was necessary to slow down the production rate of prior machines.

SUMMARY OF THE INVENTION

The aim of the present invention is to overcome the above mentioned drawbacks and provide a production rate increase in a cold forging machine of the above type, so as to achieve a production rate up to 150-200 pieces per minute, while assuring a very safe gripping and locking of the workpiece by the transfer pliers jaws, as the workpiece is ejected by a related forging die.

According to the present invention, the above aim is achieved by a workpiece supporting device for a multiple-die horizontal forging press, with a transfer pliers arranged at each recess of a forging die and including a movable stem operating as a workpiece ejecting means, the movable stem being coupled, at an end portion thereof facing a driving mechanism, through a coupling bracket, to a driving rod, having an end portion thereof, arranged at the recess of the die, respectively of the transfer pliers, housing a workpiece restraining device formed by a rocker mechanism adapted to swing about a cross pivot pin and against a spring means affecting an arm of the rocker mechanism.

Further advantages of the invention will become more apparent from the following disclosure, the dependent claims and the accompanying drawings.

BRIEF DESCRIPTION OF THE DRAWINGS

The subject matter of the invention will be disclosed and illustrated in a more detailed manner hereinafter with reference to an exemplary embodiment thereof shown in the accompanying drawings, where.

DESCRIPTION OF THE PREFERRED EMBODIMENT

Figure 1:
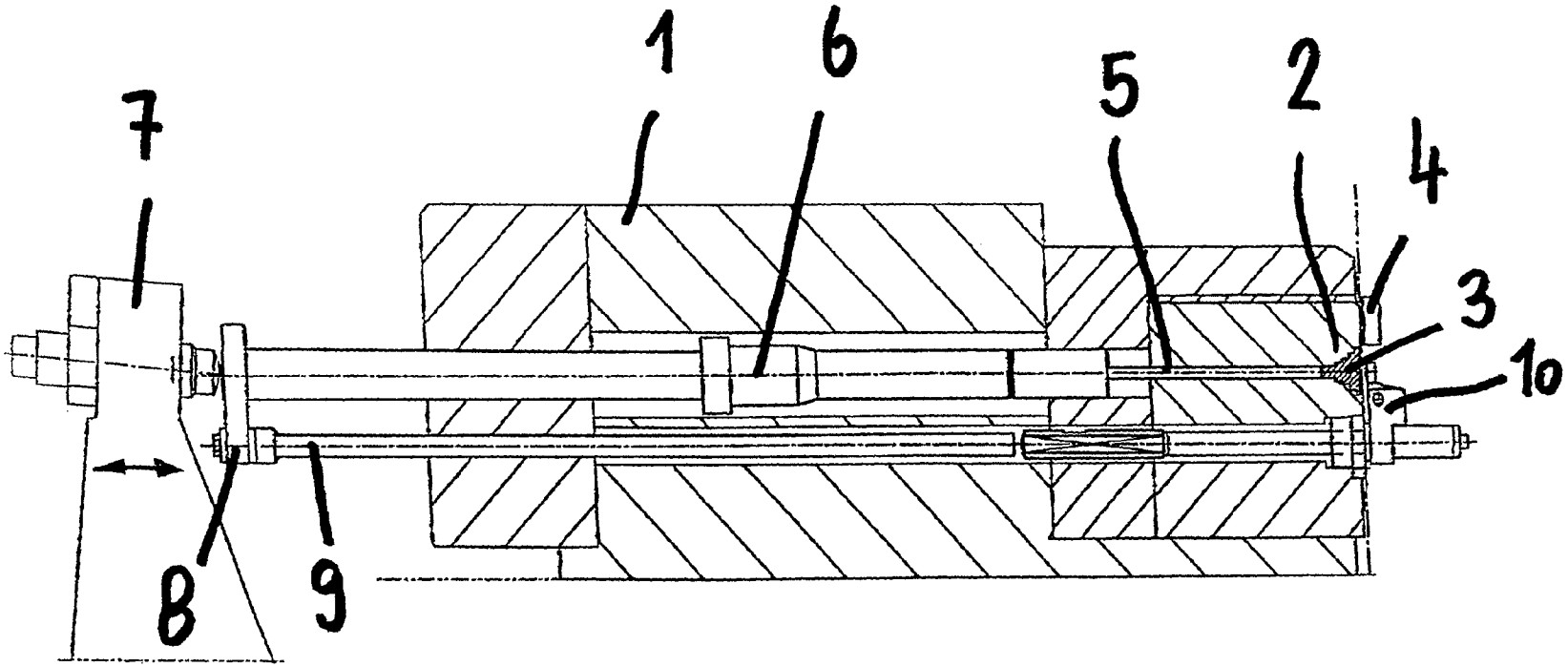
FIG. 1 is a cross-sectional view of a forging die including a workpiece ejecting mechanism and a counter-biasing device in a standby position thereof.

FIG. 1 is a cross-sectional view showing a zone of a prior cold deforming head, generally indicated by 1.

The cold deforming head 1 comprises, on a front side thereof, a forging die 2 receiving a cold deformed workpiece 3, to be further transferred by a known transferring pliers 4.

In particular the workpiece 3 is transferred by actuating an ejecting rod 5, driven by a driving stem 6 operatively connected with a per se known movable reciprocating mechanism 7.

By a coupling bracket 8, the movable stem 6 is operatively coupled to a rod 9 which supports, at the die housing the workpiece 3, a detent or restraining mechanism 10 for restraining the workpiece 3, as it will be disclosed in a more detailed manner hereinafter.

The stem 6 is driven, in a fully synchronized manner with the rod 9 which supports, at the die 2, said workpiece 3.

Figure 2:
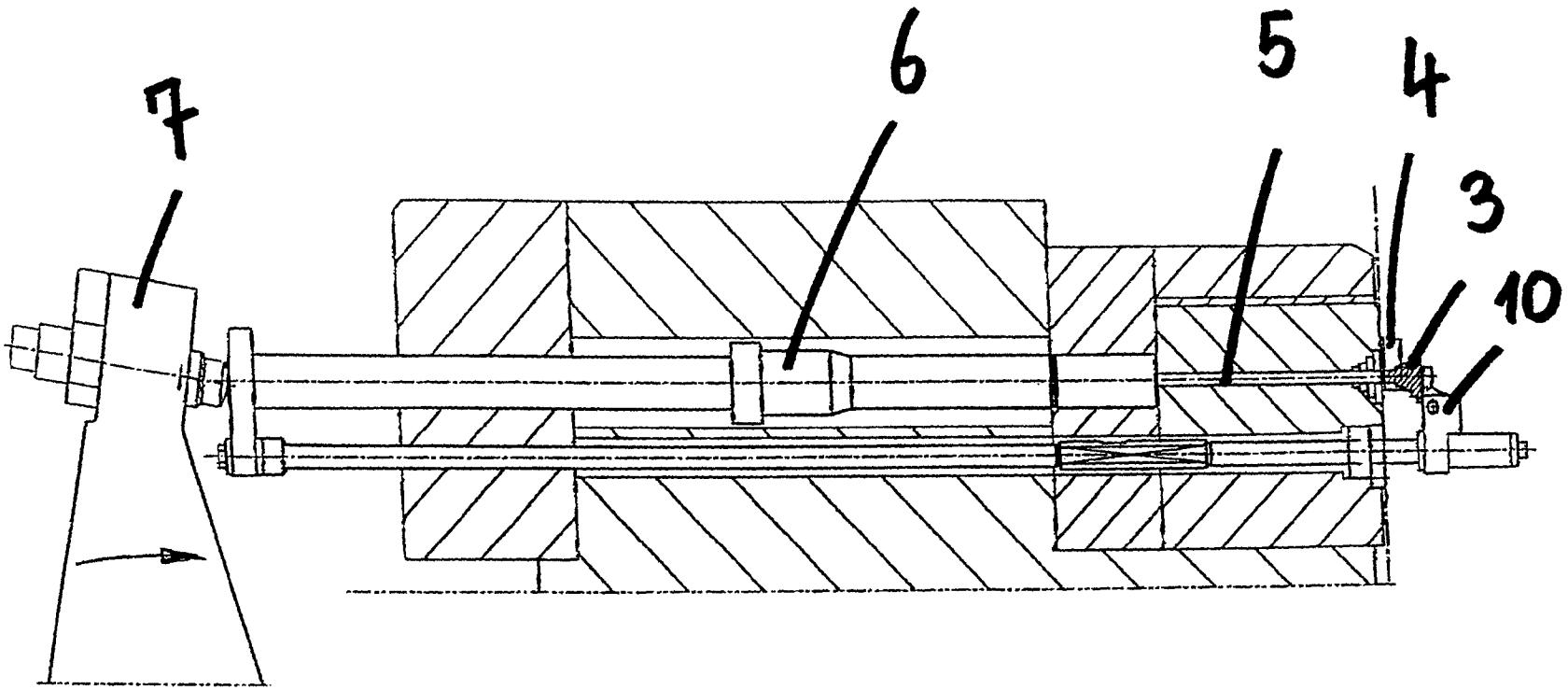
FIG. 2 shows the forging die of FIG. 1 during the ejection of a workpiece abutting against a detent abutment.

FIG. 2 shows the driving stem 6 actuated by the swinging device 7, to eject, through the ejecting rod 5, the finished workpiece 3 which is pressed by said rod 5 against the restraining or detent device 10, thereby allowing the workpiece 3, in its position shown in FIG. 2, to be safely gripped by the pliers 4.

Figure 3:
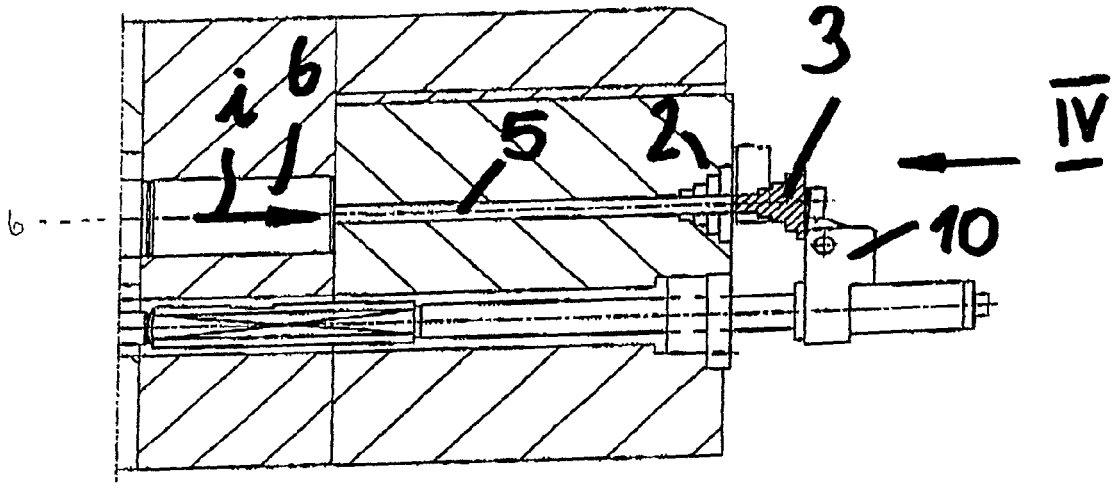
FIG. 3 shows the workpiece fully ejected from the die, abutting against the detent abutment and being gripped by the transfer pliers.

The workpiece 3 ejecting step is again shown in FIG. 3. It is possible to clearly see herein that, as the ejecting rod 5 is driven in the direction shown by the arrow (i) by driving of the stem 6, the workpiece 3 will be ejected from the die 2, to abut against the restraining or detent mechanism 10.

Figure 4:
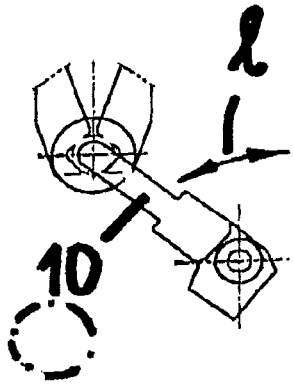
FIG. 4 schematically shows the detent abutment, as seen in the direction of the arrow IV of FIG. 3.

FIG. 4 shows that the restraining mechanism 10 can be reciprocatedly swingably driven, from a workpiece 3 restraining position to a deactuated position, as shown by the arrow I.

Thus, the disc-like end portion of the restraining device 10 is arranged in front of the workpiece 3 being ejected, or at a position whereat said die respectively pliers is not hindered.

Figure 5:
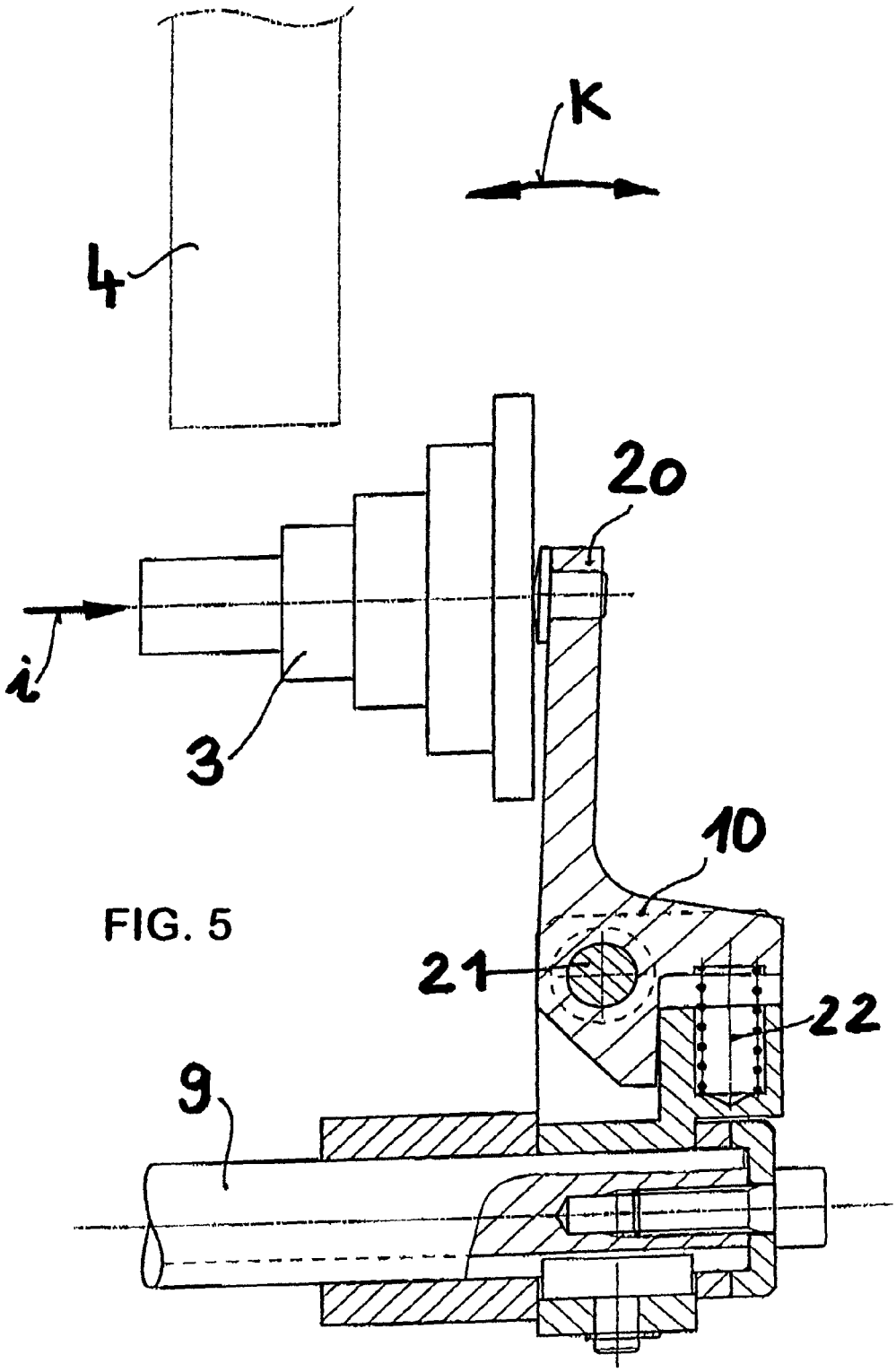
FIG. 5 is a detail cross-sectional view illustrating the device forming the detent abutment for restraining the workpiece exiting the die.

From the cross-sectional view of FIG. 5 it is possible to see the workpiece 3 ejected in the direction shown by the arrow (i) and meeting with the arm 20 of the restraining device 10.

Advantageously, the arm 20, designed as a rocker mechanism, is swingably reciprocatedly supported as shown by the arrow (k) by a cross pin 21.

Moreover, said arm 10 is urged by a spring 22 tending to hinder, by a calibrated force, the workpiece 3 ejecting movement (i).

The invention claimed is:

1. A device for supporting a workpiece to be forged in, and transferred between, successive forging dies of a cold forging pressing machine, the device comprising:

an elongated ejecting rod extending along a first longitudinal axis into each die, and movable along the first longitudinal axis into abutting engagement with the workpiece in each die to eject the workpiece from each die, an elongated support rod extending through each die along a second longitudinal axis that is parallel to the first longitudinal axis, and movable along the second longitudinal axis through each die;

a reciprocating drive mechanism coupled to both the ejecting rod and the support rod for jointly moving the ejecting rod and the support rod along their respective axes; and a workpiece restraining mechanism mounted for joint movement on the support rod remotely from each die, the restraining mechanism having an upright arm for resiliently abutting against the workpiece after ejection from each die, the upright arm and the abutting ejecting rod being together operative for holding the workpiece after ejection from each die.

2. The device according to claim 1, wherein the ejecting rod has a drive end that abuts against one side of the workpiece, and wherein the drive mechanism has a drive stem coupled to an opposite end of the ejecting rod.

3. The device according to claim 1, wherein the drive mechanism includes a coupling bracket remote from each die for coupling the ejecting rod and the support rod together.

4. The device according to claim 1, wherein the upright arm is pivotable about a pivot axis that is transverse to the longitudinal axes, and wherein the drive mechanism includes a spring for constantly biasing the upright arm into abutting engagement with the workpiece after ejection from each die.

5. The device according to claim 1, wherein the upright arm and the abutting ejecting rod engage opposite workpiece sides of the workpiece to enable free access to the workpiece between the opposite workpiece sides by a transfer tool.

* * * * *